United States Patent [19]

Gerhart

[11] Patent Number: 4,475,531

[45] Date of Patent: Oct. 9, 1984

[54] FIREPLACE UNIT

[75] Inventor: Roland T. Gerhart, Milford Township, Oakland County, Mich.

[73] Assignee: IEM Ltd., Novi, Mich.

[21] Appl. No.: 399,393

[22] Filed: Jul. 19, 1982

Related U.S. Application Data

[63] Continuation of Ser. No. 138,811, Apr. 9, 1980, abandoned.

[51] Int. Cl.[3] ..... F24B 7/00

[52] U.S. Cl. ..... 126/121; 237/51; 126/123

[58] Field of Search ..... 126/121, 120, 131, 143, 126/112, 77, 123; 237/51; 415/207

[56] References Cited

U.S. PATENT DOCUMENTS

| | | | |
|---|---|---|---|
| 2,231,258 | 2/1941 | Elmore | 237/51 |
| 4,026,263 | 5/1977 | Boyd | 126/121 |
| 4,059,090 | 11/1977 | Shaw | 126/121 |
| 4,170,219 | 10/1979 | Hansen et al. | 126/121 |
| 4,179,065 | 12/1979 | Zung | 237/51 |
| 4,224,921 | 9/1980 | Petrescue | 126/121 |
| 4,280,473 | 7/1981 | Hempel | 126/121 X |

FOREIGN PATENT DOCUMENTS

| | | | |
|---|---|---|---|
| 844348 | 8/1960 | United Kingdom | 126/121 |

*Primary Examiner*—Randall L. Green

*Attorney, Agent, or Firm*—Flynn, Thiel, Boutell & Tanis

[57] ABSTRACT

A fireplace unit provided with a fan below the bottom wall of the fire box for circulating room air around the fire box.

11 Claims, 7 Drawing Figures

FIREPLACE UNIT

This is a continuation of application Ser. No. 138,811, filed Apr. 9, 1980, now abandoned.

This invention relates to an improved fireplace unit useful as an efficient heat source for a living space, such as a home.

The fireplace unit according to the invention can be used in new construction, in lieu of a masonry fireplace, by placing the fireplace unit in an appropriately shaped opening in a building wall. Also, the fireplace unit according to the invention can be used as a fireplace conversion unit for converting a pre-existing masonry fireplace into a more efficient heat source. Further, by equipping the fireplace unit with an outer cabinet and a pedestal, if needed, the unit can be used as a freestanding stove.

The following description will proceed primarily with reference to the use of the fireplace unit as a conversion unit for an existing open fireplace. However, it is to be understood that the fireplace unit according to the invention can also be used in new construction, instead of building a masonry fireplace, or it can be used as a freestanding stove, as noted above.

It is well known that conventional residential open fireplaces are not efficient heat sources and, in fact, most of them are responsible for extensive heat loss because they allow warm room air to escape up the chimney. A wide variety of structures have been suggested to overcome this disadvantage. One of the known devices is a conversion unit which can be inserted into an existing fireplace so as to close off the open front side thereof. The conversion unit includes structure effective to draw in relatively cool floor level air, circulate it upwardly around a fire box so that it becomes heated and then return the heated air to the room through a grille or grilles located at the top of the conversion unit. The conversion unit is a heavy steel shell designed to fit inside the existing fireplace and carrying closure panel means for engaging the building wall around the perimeter of the existing fireplace opening therein. Walls defining a fire box are provided inside of and spaced from the shell. The space between the fire box and the shell defines the air flow passage. The fire box has an exhaust conduit extending upwardly therefrom and through the shell for communication with the flue of the fireplace. A damper is provided in association with that exhaust conduit. The front of the fire box is normally closed by openable doors, usually made of tempered glass. A fan can be provided to effect forced circulation of air through the air flow passage.

The heat efficiency of the aforementioned type of fireplace conversion unit is vitally related to the volumetric flow rate of the air that is circulated through the air flow passage. The fans used to increase the air flow rate in the prior art conversion units have not been completely satisfactory for a variety of reasons. Many of them are too noisy. Others are incapable of achieving sufficient air flow rates to achieve maximum heat recovery. Others have required too much space so that the fireplace conversion unit was too bulky or the fan had to be located outside the fireplace unit.

Accordingly, it is an object of this invention to provide a fireplace unit of the type described above which is provided with an improved fan unit for quietly circulating a large volume of air in the air flow passage in order to increase the heat recovery.

It is a further object of the invention to provide an improved fireplace unit, as aforesaid, in which the fan is positioned horizontally under the bottom wall of the fire box and is effective efficiently to draw in floor level air and circulate it at a high volumetric flow rate through the air flow passage.

It is a further object of the invention to provide an improved fireplace unit, as aforesaid, in which the fan comprises specially shaped blades and baffling in order to maximize air flow while at the same time occupying a minimum amount of space, thereby making it possible to locate the fan in the small space underneath the fire box and also making it possible to remove the fan for servicing.

It is another object of the invention to provide an improved fireplace unit, as aforesaid, in which the fan can be used to supply pressurized air to the grate to provide for easy starting of the fire and to make it possible to use coal and other biomass materials, as well as wood, as a fuel in the fireplace unit.

Other objects and advantages of the invention will become apparent from a reading of the following description of a preferred embodiment of the invention, taken in conjunction with the accompanying drawings.

DESCRIPTION OF THE PREFERRED EMBODIMENT

Figure 1:
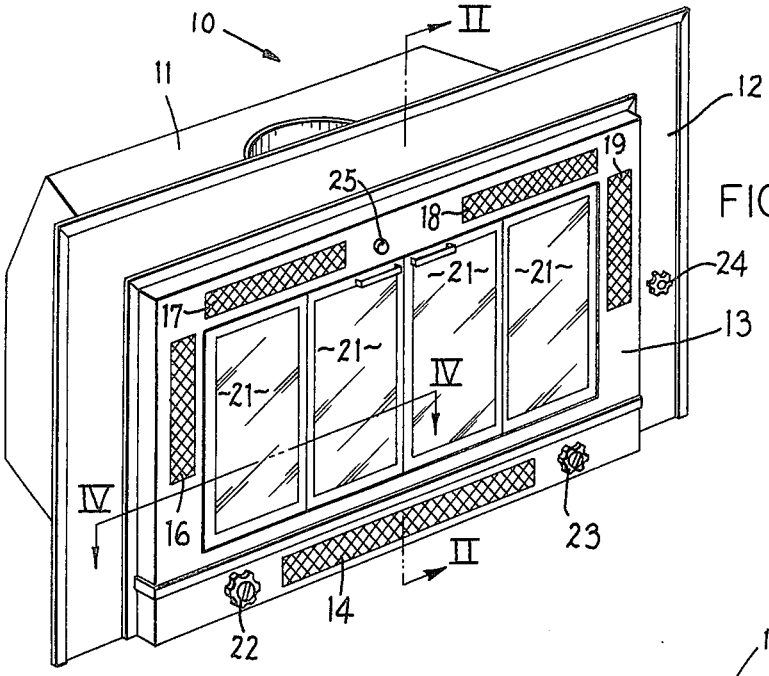
FIG. 1 is a perspective view of the fireplace unit according to the invention.

Referring to FIGS. 1 to 5 of the drawings, the fireplace unit 10 comprises an outer shell 11 having a size and shape such that it can be inserted into an existing fireplace opening in a living space, such as a home, or into an appropriately shaped opening in a building wall, in the case of new construction. In most instances, existing fireplaces are tapered from front to rear and, also, the upper end of the rear wall thereof slants forwardly in the upward direction. The outer shell 11 is correspondingly shaped in the illustrate embodiment of the invention. A closure panel 12 surrounds the sides and upper end of the shell 11 close to the forward end thereof. The closure panel 12 projects laterally outwardly from the shell 11 and it is adapted to engage the building wall around the sides and top of the fireplace opening therein, whereby the fireplace opening is substantially completely closed off by the fireplace conversion unit. A variety of different closure panels can be used so that the facade of the unit can match the decor of the room in which the unit is installed.

The shell 11 is here shown as projecting forwardly from the closure panel 12 a short distance. However, the front wall of the shell 11 can be flush with the closure panel 12, if desired. The shell 11 has a front wall 13 which has a centrally located air inlet opening 14 covered by a grille adjacent to its lower end. Heated air outlet openings 16, 17, 18 and 19, covered by grilles, are provided along the upper edge and at the upper ends of the side edges of the front wall 13. In some embodiments of the invention, the outlet openings 16 and 19 at the upper ends of the side edges of the front wall are omitted. The central portion of the front wall defines an opening which is closable by glass doors 21. The glass doors 21 are mounted for hinging movement between open and closed positions in any conventional manner. It is preferred to use Vycor glass (borosilicate glass) for the doors 21 for resistance to thermally induced shattering. Operating knobs 22 and 23 are provided adjacent the lower edge of the front wall for controlling the supply of combustion air to the fire box. Also, a control knob 24 for controlling operation of the fan, to be described hereinbelow, is mounted on the closure panel 12. A knob 25 for operating the damper is mounted on the front wall 13 adjacent to the upper edge thereof.

An inner shell 26, defining a fire box, is disposed inside the outer shell 11. The inner shell 26 has a shape substantially corresponding to the shape of the outer shell, but it is of smaller dimensions horizontally and vertically so as to define an air flow passage 27 between the two shells. Thus, the bottom, side, back and top walls of the inner shell 26 are inwardly spaced from the corresponding walls of the outer shell. The air flow passage 27 substantially completely surrounds the inner shell 26, except for the open front side thereof. The front wall 13 closes the air flow passage 27 at the front end thereof, except for the air inlet and outlet openings described above.

An upright conduit 28 extends between and penetrates through the upper walls of the inner and outer shells 11 and 26 at vertically aligned locations thereon directly above the location of the grate. The conduit 28 is adapted to communicate with the flue of the building for discharging the gaseous products of combustion from the fire box. A damper 30 is provided in the conduit 28 to control air flow therethrough. A baffle 29 is mounted inside the inner shell 26 and is located vertically downwardly spaced from and directly below the lower end of the conduit 28. As is well known, when the fire is burning, the baffle 29 retards discharging of the gaseous products of combustion from the fire box whereby to improve the heat recovery from the fireplace unit. The baffle 29 can be made of stainless steel for maximum useful life.

Fins 31 extend from the external surface of the back wall of the inner shell 26 partway toward the outer shell 11 to increase the external heat transfer area of the inner shell. The fins 31 extend substantially vertically so as not substantially to obstruct the air flow. For example, the fins 31 can be defined by substantially U-shaped members whose bases are secured to the back wall of the inner shell 26 and whose legs extend perpendicularly to the back wall of the inner shell 26. Horizontal fins 32 are mounted on the outer surface of the conduit 28 between the inner and outer shells, for the same purpose. The fins 32 can be made of steel, but it is preferred to make the fins 32 of copper to increase the heat recovery of the fireplace unit.

The portion of the air flow passage 27 located between the upper walls of the inner shell 26 and the outer shell 11 communicates with the upper heated air outlet openings 17 and 18 which are covered by grilles. The portions of the air flow passage 27 located between the side walls of the inner shell 26 and the outer shell 11, on the respective opposite sides thereof, communicate with the side heated air outlet openings 16 and 19 which are covered by grilles. When the heated air outlet openings 16 and 19 are omitted, the air that flows around the side walls of the fire box escapes through the openings 17 and 18.

A grate 33 is mounted inside the inner shell 26 adjacent to the bottom wall thereof and substantially directly below the conduit 28. The grate is here shown as being comprised of a plurality of tubes 34 which extend from front to rear and have air discharge openings 35 therethrough. The tubes 34 preferably are made of stainless steel for maximum useful life. The rear ends of the tubes 34 are supported by legs 36 and the front ends of the tubes are supported by a manifold 37 which is supported by hollow legs 38. The manner by which combustion air is supplied to the legs 38 will be described hereinbelow.

A protective screen 41, made of metal mesh may be hung inside the inner shell 26 adjacent to the front side thereof to prevent sparks from entering the living space when the doors are open.

Figure 2:
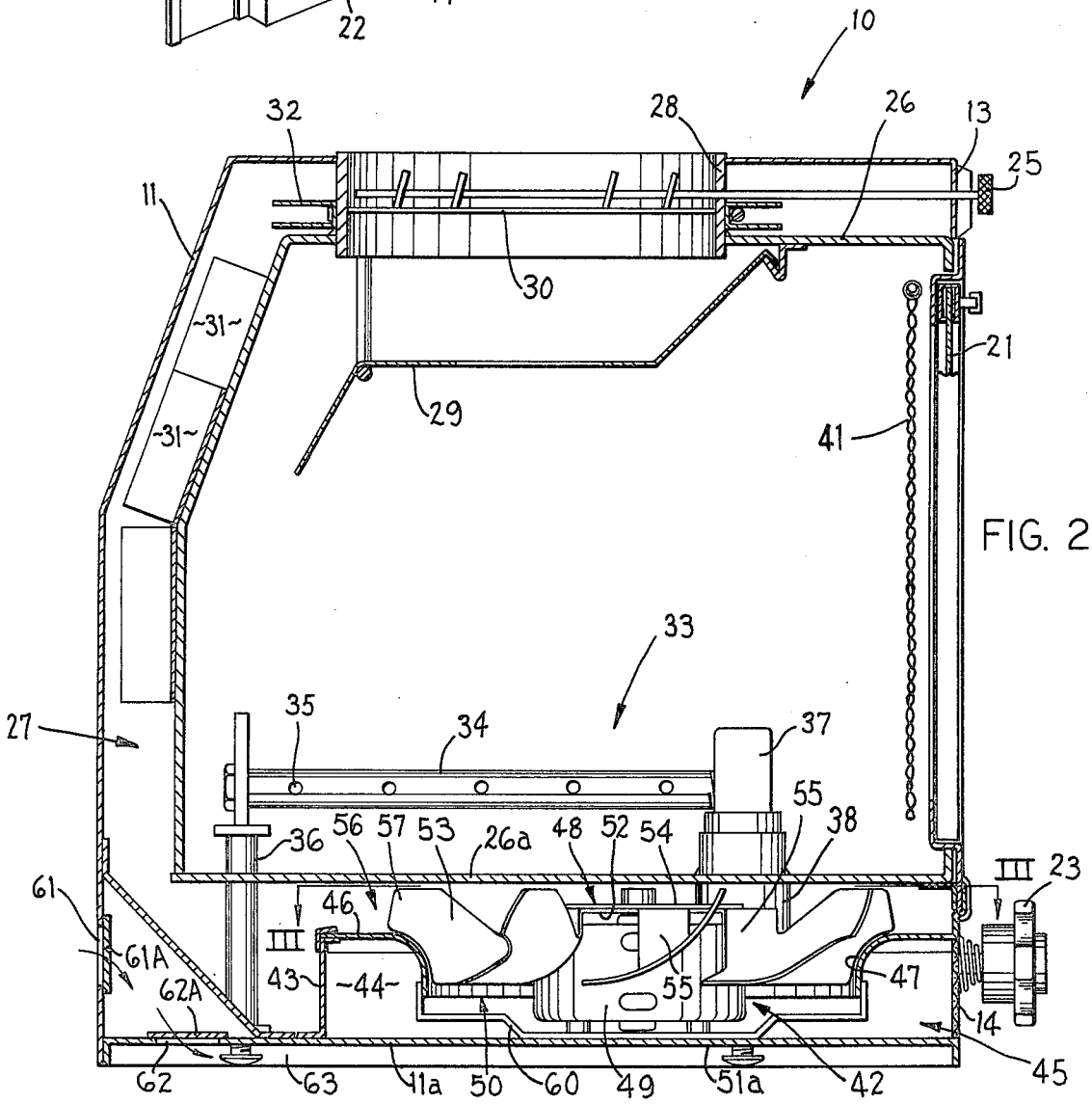
FIG. 2 is a sectional view taken along the line II—II in FIG. 1.

In the space between the bottom wall **26*a* of the inner shell and the bottom wall 11*a* of the outer shell 11, there is provided a fan unit 42 which is centrally located behind the air inlet opening 14. The fan unit 42 comprises an inlet housing 45 defined by a rear wall 43 and two side walls, one of which is shown at 44. The two side walls extend to the front wall 13 of the outer shell 11 on opposite sides of the opening 14. The bottom of the inlet housing is closed by the bottom wall 11*a* of the outer shell 11. The inlet housing is open at the front side thereof to receive air from the air inlet opening 14. The inlet housing has a top wall 46 having a circular central opening 50. The edge of the central opening 50 in the top wall 46 is curved downwardly in an arcuate shape as shown in FIG. 2 whereby to define an upwardly extending, smoothly flaring, inlet cone or shroud 47. A direct drive, air-moving impeller 48 is positioned in vertical alignment with and its lower end extends into the inlet shroud 47. The electric motor 49 for driving the impeller 48 is supported on a mounting bracket 60 by means including vibration dampers 51. The bracket 60 extends diametrically across the shroud 47 and the ends of said bracket are affixed to said shroud. The impeller 48 comprises an annular back plate 52 having fan blades 53 mounted thereon at equal circumferentially spaced intervals. It is preferred to make from a single sheet of material, a one-piece assembly of the back plate 52 and the fan blades 53 wherein the blades are made by die forming to obtain a precision balanced impeller. The stiffening plate 54 is secured to the upper side of back plate 52, for example, by rivets. The stiffening plate 54 can be omitted and stiffening can be provided by ribs on the back plate 52**, if desired.

Figure 3:
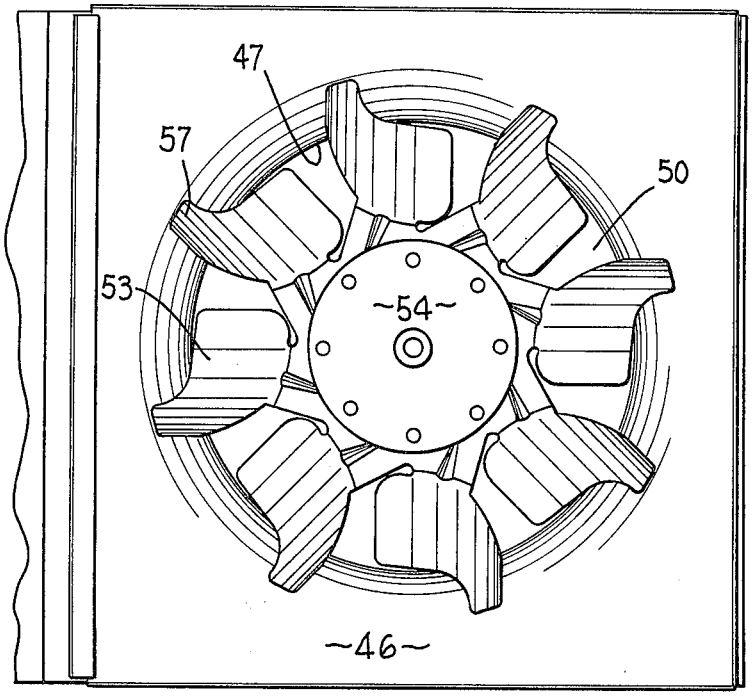
FIG. 3 is a top plan view of the impeller of the fan taken along the line III—III in FIG. 2.
Figure 4:
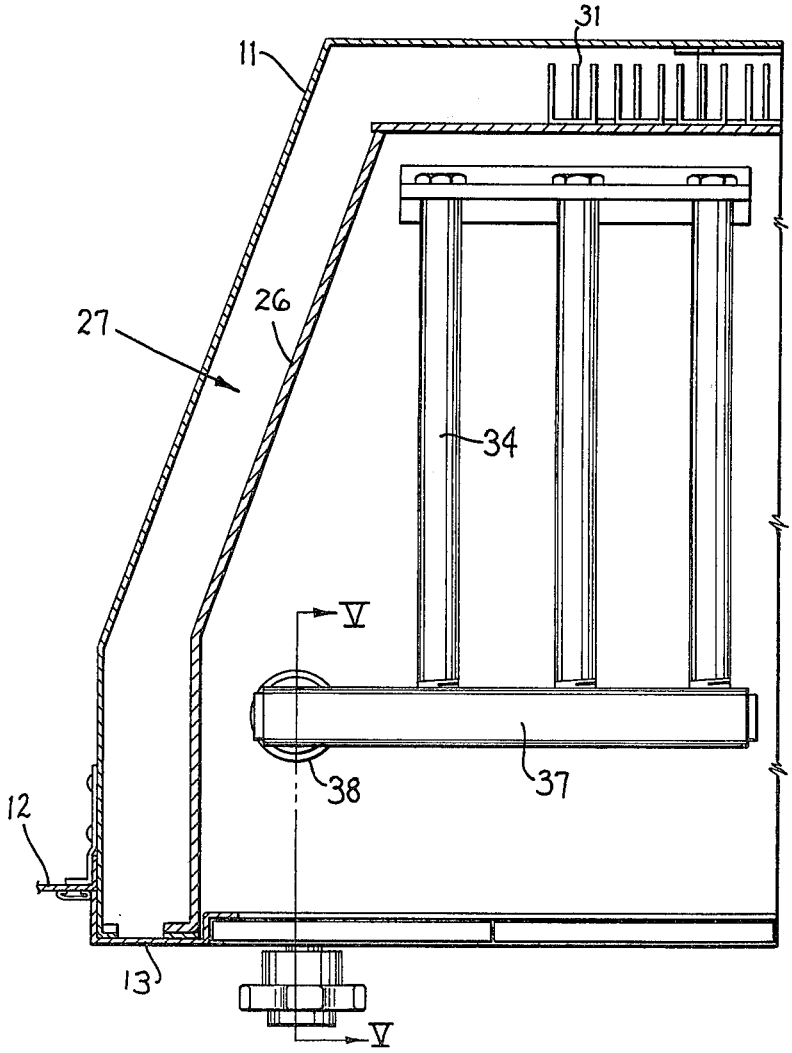
FIG. 4 is a horizontal half-sectional view of a portion of the fireplace unit taken along the line IV—IV in FIG. 1, the other half of the fireplace unit being symmetrical therewith.

The fan blades 53 are joined to the perimeter of the back plate 52 by downwardly extending legs 55. It will be noted that the legs 55 extend alongside and substantially parallel with the motor 49, whereby the motor is partially received within the central zone of the impeller to provide a compact unit. Each of the fan blades 53 is elongated and it extends laterally outwardly from the lower end of its associated leg 55. As most clearly shown in FIG. 2, in side view the blades 53 are arcuate and they are smoothly curved upwardly in a direction toward the front of the fireplace unit. The lower portions of the radially outer edges of the fan blades 53 are curved so as to substantially conform to the curvature of the inlet shroud 47. Thus the lower portions of the fan blades 53 fit within and are rotatable within the inlet shroud 47 over substantially the entire vertical extent thereof. As appearing in FIG. 2, the fan blades move from the front toward the rear of the fireplace unit 10 so that they pick up and impel the air toward the space 56 between the wall 46 and the wall 26*a*. As best shown in FIG. 3, at the upper and outer end of each fan blade, there is provided an outwardly extending fan blade extension section 57 which extends over the upper portion of the inlet shroud 47 and into the space 56 between the bottom wall 26*a* of the inner shell and the top wall 46 of the inlet housing, which latter space 56 defines the outlet of the fan unit. The outer edge of the fan blade extension section 57 extends substantially vertically and said extension section extends upwardly to a position close to the lower surface of wall 26*a*. It will be noted that the fan blade section 58 has the same curvature as the remainder of the fan blade.

It will be noted that the fan unit 42 comprising the bracket 60, the motor 49, the fan blades and the top wall 46 forms an integral unit which can be removed for servicing, when needed.

Thus, the lower portions of fan blades 53 impel the air to the outer fan blade extension sections 57 and the latter impel the air more or less centrifugally into the space 56. Thus, air under positive pressure becomes present in the space 56. The air impelled into space 56 travels through the air flow passage 27 and becomes heated, and then the heated air is discharged back into the living space through the openings 16, 17, 18 and 19. The incoming air flows around the motor 49 whereby to cool same.

Outside air or room air can be supplied to the fire box in a variety of ways for combustion of the fuel therein. Outside air can be supplied in the following way. An opening 61 (FIG. 2), adapted for communication with the outside air, is provided in the lower portion of the rear wall of the shell 11. The outside air flows through a hole 62 in the bottom wall 11*a* and through the passage 63 below said bottom wall to the front of the fireplace unit. Another hole 64 (FIG. 5) is provided in the bottom wall 11*a* close to each of the legs 38 so that the outside air can flow into the compartment 66. The valve 39 controls flow of outside air into the leg 38 from the compartment 66 via the hole 67. When outside air is not used for combustion, the holes 61, 62 and 64 are closed by knock-out plates 61A, 62A and 64A, respectively. Room air can be supplied through an opening 65 in the front wall 13, which opening is covered by a grille and is located behind the knobs 22 and 23. When outside air is used for combustion, the opening 65 is covered by a removable plate 70.

Another hole 68 is provided in the leg 38. The hole 68 communicates with the space 56 which receives pressurized air from the fan. A spring plate 69 covers the hole 68. The knob 22 includes an inner section 71 which is independently rotatable relative to the outer section thereof. An actuating rod 72 is affixed to the inner section 71 for rotation therewith. The rod 72 is threadedly engaged with internal threads of the rod 73 for actuating the valve 39 whereby rod 72 can be moved axially relative to rod 73. The inner end of rod 72 is connected to the central portion of spring plate 69 whereby axial movement of rod 72 is effective to bend said spring plate whereby to open or close the opening 68. When the opening 68 is open, pressurized air from space 56 flows into the leg 38 and thence through the tubes 34 and opening 35 to create forced draft conditions in the fuel on the grate. This is effective to permit ignition and burning of relatively difficult-to-ignite fuels, such as coal. Thus, both outside air and forced draft room air, or room air and forced draft room air, can be supplied to the grate, as air for combustion, according to need.

Of course, if desired, combustion air can be supplied by opening the doors 21.

Figure 6:
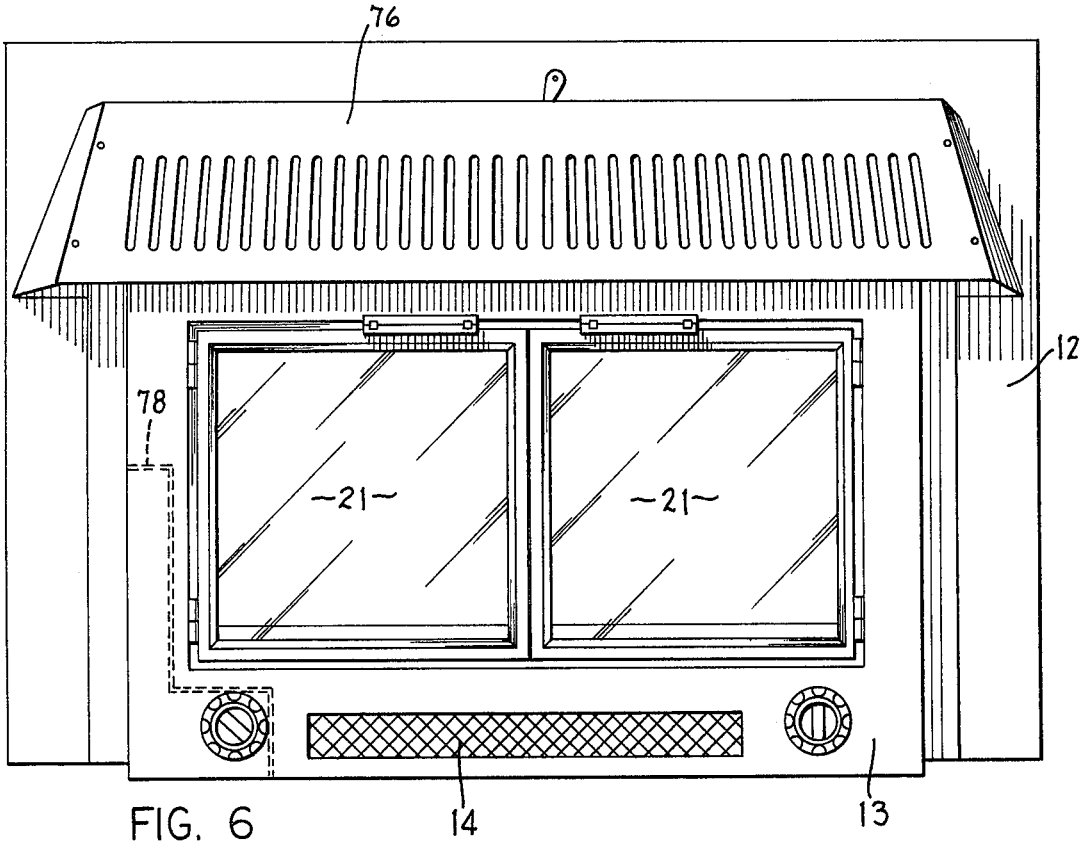
FIG. 6 is a front view of a modified fireplace unit.
Figure 7:
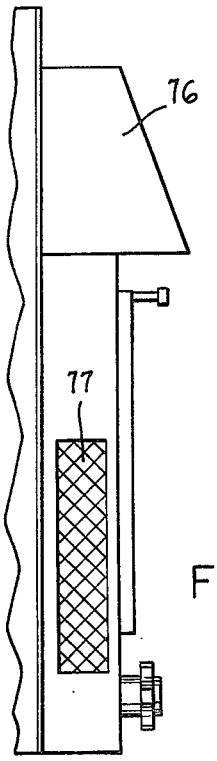
FIG. 7 is a side view of the front portion of the modified fireplace unit of FIG. 6.
Figure 5:
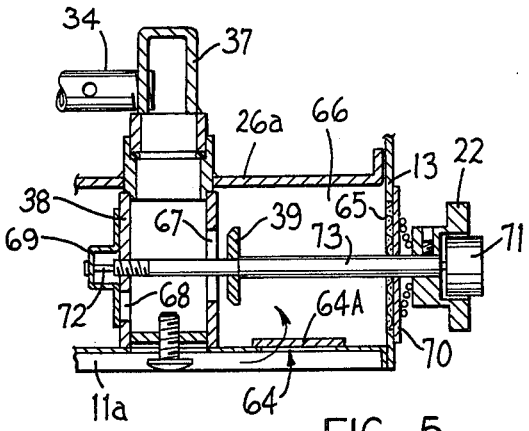
FIG. 5 is a sectional view taken along the line V—V in FIG. 4.

FIGS. 6 and 7 show an alternate fireplace unit design in which the openings 16 and 19 are omitted and a decorative hood 76 extends in front of the openings 17 and 18. These figures show an alternate room air supply for combustion. Openings 77 covered by grilles are provided in the side walls of the unit adjacent the forward edges thereof. An internal baffle 78 directs air therefrom into the compartment 66. The openings 77 can be covered by removable plates when room air is not used for combustion.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A fireplace unit, comprising: an inner fire box shell having a substantially horizontal bottom wall, a top wall, a back wall, opposite side walls and an open front; an outer fireplace shell within which said inner shell is contained, said outer fireplace shell having walls corresponding to said bottom, top, back and side walls of said inner shell and disposed in spaced relation thereto so as to form an air flow passage between said shells; a front wall closing the front end of said air flow passage, said front wall having a closeable front opening in registry with said open front of said inner shell, said front wall having room air inlet opening means located below said closeable front opening and communicating with the space between said bottom walls of said inner and outer shells, said front wall having heated air outlet opening means communicating with the space between said top walls of said shells; door means on said front wall for closing said front opening of said front wall, air supply means for supplying combustion air to the interior of said inner shell, the interior of said inner shell being isolated from the space between said inner and outer shells except for said air supply means; a conduit extending from the upper end of said inner shell for discharging combustion gases therefrom; a fan unit disposed in the space between said bottom walls of said inner and outer shells and located directly rearwardly of said room air inlet opening means, said fan unit comprising an inlet housing the lower end of which communicates with said room air inlet opening means, said inlet housing comprising a substantially horizontal upper wall located directly below, spaced downwardly from and extending substantially parallel with said bottom wall of said inner shell, said upper wall having an annular air inlet shroud extending downwardly therefrom partway to the lower end of said inlet housing, said shroud being defined by a downwardly and inwardly smoothly curved inner shroud wall defining a downwardly converging vertical passage having a circular air inlet opening of said shroud at its lower end, the upper end of said passage defining an enlarged circular air outlet opening of said shroud, said circular air inlet opening and said enlarged circular air outlet opening of said shroud being coaxial with the vertical central axis of said vertical passage; a direct drive rotatable fan disposed within said downwardly converging vertical passage, said fan being rotatable about a vertical axis coaxial with the vertical central axis of said vertical passage, said fan having a series of corresponding, circumferentially space-apart, radially outwardly extending fan blades, said fan blades each being smoothly arcuately upwardly curved when viewed from the radially outer end thereof, said fan blades each including a lower portion and an upper portion, said lower portion extending downwardly in said downwardly converging vertical passage and having a radially outer edge substantially conforming to the curvature of said shroud wall, said upper portion extending upwardly and radially outwardly from said lower portion into the space defined between said upper wall of said inlet housing and said bottom wall of said inner shell and surrounding said circular air outlet opening of said inlet housing, said fan being effective to move air from said inlet housing upwardly through said downwardly converging vertical passage and then direct the air horizontally into the space between said upper wall of said inlet housing and said bottom wall of said inner shell whereupon the air then flows through said air flow passage and becomes heated and is then discharged through said heated air outlet opening means.

2. A fireplace unit as claimed in claim 1 in which said bottom walls of said outer shell and said inner shell are substantially horizontal and substantially parallel with each other, said inlet housing having side walls extending downwardly from said housing upper wall to said bottom wall of said outer shell, said side walls extending to said room air inlet opening means, said inlet housing being closed except for said air inlet opening means and said circular air outlet opening of said shroud.

3. A fireplace unit as claimed in claim 1 or claim 2 in which the direct drive rotatable fan comprises an electric motor disposed within said downwardly converging vertical passage and extending upwardly through said circular air outlet opening in said shroud with the shaft of said motor being coaxial with the vertical central axis of said vertical passage, a horizontal back plate mounted on the upper end of the shaft of said motor for rotation therewith, said fan blades being mounted on the underside of said back plate for rotation therewith.

4. A fireplace unit as claimed in claim 1 wherein said air supply means comprises upright hollow conduit means extending upwardly through said bottom wall of said inner shell into the interior of said inner shell for supplying combustion air thereto, a first opening in said hollow conduit means below said bottom wall of said inner shell, a first valve for opening and closing said first opening and manually operable actuating means on said front wall for actuating said first valve to open and close said first opening, said first opening communicating with either a source of outside air or room air, said upright hollow conduit means being the sole means for supplying combustion air to the interior of said inner shell when said closeable front opening is closed by said door means.

5. A fireplace unit as claimed in claim 4 including a second opening in said hollow conduit means below said bottom wall of said inner shell, a second valve for opening and closing said second opening and manually operable actuating means on said front wall for actuating said second valve to open and close said second opening, said second opening communicating with the space defined between said upper wall of said inlet housing and said bottom wall of said inner shell so that forced draft combustion air can be supplied to the interior of said inner shell.

6. A fireplace unit as claimed in claim 4 or claim 5 including first passage means communicating with said first opening and adapted for communication with outside air, second passage means communicating with said first opening and extending through said front wall, said side wall or both of said front and side walls of said outer shell for communication with room air, and closure means for selectively closing either said first passage means or said second passage means so that either outside air or room air can be supplied as combustion air.

7. A fireplace unit as claimed in claim 6 including a grate disposed inside said inner fire box shell close to the bottom wall thereof, said grate comprising substantially horizontal tubes having openings for discharging combustion air into solid fuel supported on said tubes, said tubes communicating with the interior of said hollow conduit means.

8. A fireplace unit, comprising: an inner fire box shell having a bottom wall, a top wall, a rear wall, opposite side walls and an open front; an outer fireplace shell within which said inner shell is contained, said outer fireplace shell having walls corresponding to said bottom, top, rear and side walls of said inner shell and disposed in spaced relation thereto so as to form an air flow passage between said shells; a front wall closing the front end of said air flow passage, said front wall having a closeable front opening in registry with said open front of said inner shell, said front wall having room air inlet opening means communicating with the space between said bottom walls of said inner and outer shells and having heated air outlet opening means communicating with the space between said top walls of said shells; door means on said front wall for closing said front opening of said front wall; air supply means for supplying combustion air to the interior of said inner shell; a conduit extending from the upper end of said inner shell for discharging combustion gases therefrom; a fan unit disposed in the space between said bottom walls of said inner and outer shells, said fan unit comprising an inlet housing communicating with said air inlet opening means, said inlet housing comprising a substantially horizontal upper wall located directly below spaced downwardly from and extending substantially parallel with said bottom wall of said inner shell, said upper wall having an annular air inlet shroud extending downwardly therefrom partway to the lower end of said housing, said shroud being defined by a downwardly and inwardly smoothly curved inner shroud wall defining a downwardly converging vertical passage having a circular air inlet opening of said shroud at its lower end, the upper end of said shroud defining an enlarged circular air outlet opening of said inlet housing; a direct drive rotatable impeller disposed coaxial with the vertical axis of said shroud, said impeller being rotatable about said vertical axis and having a series of corresponding circumferentially spaced-apart blades, said blades each being smoothly arcuately curved when viewed from the radially outer end thereof, said blades each including a lower portion and an upper portion, said lower portion extending downwardly inside said downwardly converging vertical passage in said shroud and having a radially outer edge conforming to the curvature of said shroud wall, said upper portion extending upwardly and radially outwardly from said lower portion into the space defined between said upper wall of said housing and said bottom wall of said inner shell and surrounding said circular air outlet opening of said housing, said impeller being effective to move air from said inlet housing axially upwardly through said downwardly converging vertical passage and then direct the air horizontally into the space between said upper wall of said inlet housing and said bottom wall of said inner shell whereupon the air then flows through said air flow passage and becomes heated and is then discharged through said heated air outlet opening means.

9. A fireplace unit as claimed in claim 8 in which said impeller is made of a single piece of metal having a centrally located back plate and having said blades integral with said back plate and extending radially outwardly therefrom.

10. A fireplace unit as claimed in claim 9 in which said impeller comprises downwardly extending legs extending from the perimeter of said back plate to the radially inner ends of said blades.

11. A fireplace unit, comprising: an inner fire box shell having a substantially horizontal bottom wall, a top wall, a back wall, opposite side walls and an open front; an outer fireplace shell within which said inner shell is contained, said outer fireplace shell having walls corresponding to said bottom, top, rear and side walls of said inner shell and disposed in spaced relation thereto so as to form an air flow passage between said shells; a front wall closing the front end of the space between said inner and outer shells, said front wall having a closeable front opening in registry with said open front of said inner shell, said front wall having room air inlet opening means located below said closeable front opening and communicating with the space between said bottom walls of said inner and outer shells, said front wall having heated air outlet opening means communicating with the space between said top walls of said shells; door means on said front wall for closing said front opening of said front wall, air supply means for supplying combustion air to the interior of said inner shell, the interior of said inner shell being isolated from the space between said inner and outer shells except for said air supply means; a conduit extending from the upper end of said inner shell for discharging combustion gases therefrom; a fan structure disposed in the space between said bottom walls of said inner and outer shells, said space defining an elongated lower portion of said air flow passage, said lower portion having said room air inlet opening means at one longitudinal end thereof and an air outlet opening at the opposite longitudinal end thereof, said lower portion of said air flow passage being substantially closed except for said inlet and outlet openings; said fan structure being disposed in said lower portion of said air flow passage, said fan structure comprising an inlet housing having an upper wall substantially parallel with and spaced downwardly from said bottom wall of said inner shell, said upper wall being spaced upwardly from said bottom wall of said outer shell, said inlet housing having a side wall extending to said bottom wall of said outer shell, the space between said bottom walls communicating with said air inlet opening, said upper wall having an annular air inlet shroud extending downwardly therefrom partway to said bottom wall of said outer shell, said shroud having an arcuate, smoothly upwardly flaring, inner surface so that the inner diameter of said shroud progressively increases in a direction toward said bottom wall of said inner shell, the upper end of said shroud defining a circular toroidal air outlet opening of said inlet housing; a direct drive rotatable impeller disposed coaxial with said shroud, said impeller being rotatable about a vertical axis and having a series of corresponding, circumferentially spaced-apart blades, said blades each including a lower portion and an upper portion, said lower portion extending downwardly inside of said shroud and having a radially outer arcuate edge conforming to the arcuate, smoothly upwardly flaring shape of said inner toroidal surface of said shroud, said upper portion extending upwardly into close proximity to said bottom wall of said inner shell and extending radially outwardly from said lower portion into the space between said bottom wall of said inner shell and said upper wall of said housing and surrounding said circular air outlet of said housing, said impeller being effective to move air from said inlet housing axially upwardly through said shroud and then direct the air radially into the space above said upper wall of said inlet housing whereupon the air then flows through said lower portion of said air flow passage.

* * * * *